US012232685B2

(12) United States Patent
Her et al.

(10) Patent No.: US 12,232,685 B2
(45) Date of Patent: Feb. 25, 2025

(54) CLEANER

(71) Applicant: LG ELECTRONICS INC., Seoul (KR)

(72) Inventors: Jonguk Her, Seoul (KR); Kietak Hyun, Seoul (KR); Soohan Eo, Seoul (KR); Inkyu Hwang, Seoul (KR); Jungmin Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 88 days.

(21) Appl. No.: 18/021,951

(22) PCT Filed: Sep. 24, 2021

(86) PCT No.: PCT/KR2021/013021
§ 371 (c)(1),
(2) Date: Feb. 17, 2023

(87) PCT Pub. No.: WO2022/065906
PCT Pub. Date: Mar. 31, 2022

(65) Prior Publication Data

US 2023/0240497 A1 Aug. 3, 2023

(30) Foreign Application Priority Data

Sep. 25, 2020 (KR) ..... 10-2020-0124756

(51) Int. Cl.
*A47L 9/20* (2006.01)
*A47L 9/10* (2006.01)
*A47L 9/16* (2006.01)

(52) U.S. Cl.
CPC ..... *A47L 9/20* (2013.01); *A47L 9/102* (2013.01); *A47L 9/1666* (2013.01); *A47L 9/1683* (2013.01); *A47L 9/1691* (2013.01)

(58) Field of Classification Search
CPC ..... A47L 9/20; A47L 9/102; A47L 9/1666; A47L 9/1683; A47L 9/1691; A47L 9/127;
(Continued)

(56) References Cited

U.S. PATENT DOCUMENTS

2010/0011531 A1 1/2010 Liddell et al.
2020/0008637 A1 1/2020 Nam et al.
2020/0029759 A1 1/2020 Conrad

FOREIGN PATENT DOCUMENTS

AU 2018100967 A4 * 8/2018 ..... A47L 5/24
CN 110811422 2/2020
(Continued)

OTHER PUBLICATIONS

International Search Report dated Jan. 6, 2022 issued in Application No. PCT/KR2021/013021.
(Continued)

*Primary Examiner* — Eric J Rosen
*Assistant Examiner* — Robert C Moore
(74) *Attorney, Agent, or Firm* — KED & ASSOCIATES, LLP

(57) ABSTRACT

The present disclosure relates to a cleaner capable of easily separating a filter module from a main body of the cleaner and separating and assembling the separated filter module again. Disclosed is a cleaner including: a main body; a suction motor disposed in the main body and configured to generate a suction force so as to suction air; a dust separator separating dust from air by generating a cyclone flow in air introduced by the suction motor; and a filter module having a filter for filtering air discharged from the suction motor and being detachable from the main body. Here, the filter module is configured to be easily separated from the main body of the cleaner and assembled, such that the filter disposed inside the filter module may be easily cleaned or replaced.

15 Claims, 14 Drawing Sheets

(58) Field of Classification Search
CPC ..... A47L 9/22; B65D 15/24; B65D 43/24; B65D 43/065
USPC ..... 15/347
See application file for complete search history.

(56) References Cited

FOREIGN PATENT DOCUMENTS

| | | |
|---|---|---|
| EP | 1 991 100 | 11/2017 |
| EP | 3488750 | 5/2019 |
| KR | 10-0677982 | 2/2007 |
| KR | 10-2010-0120836 | 11/2010 |
| KR | 10-1127088 | 3/2012 |
| KR | 10-2018-0078199 | 7/2018 |
| KR | 10-2020-0096968 | 8/2020 |

OTHER PUBLICATIONS

Extended European Search Report dated Sep. 13, 2024 issued in Application No. 21872934.1.

* cited by examiner

CLEANER

CROSS-REFERENCE TO RELATED PATENT APPLICATIONS

This application is a U.S. National Stage Application under 35 U.S.C. § 371 of PCT Application No. PCT/KR2021/013021, filed Sep. 24, 2021, which claims priority to Korean Patent Application No. 10-2020-0124756, filed Sep. 25, 2020, whose entire disclosures are hereby incorporated by reference.

TECHNICAL FIELD

The present disclosure relates to a cleaner, and more particularly, to a cleaner capable of easily separating a filter module from a main body of the cleaner and cleaning or replacing a filter disposed in the filter module by separating the filter module separated from the main body again.

BACKGROUND

A cleaner is a device that performs cleaning by suctioning or wiping dust or foreign substances located in a cleaning target area.

Such cleaners may be classified into a manual cleaner that a user moves in person for cleaning and an automatic cleaner that automatically moves for cleaning.

In addition, manual cleaners may fall into, depending on the types, a canister cleaner, an upright cleaner, a handy cleaner, and a stick cleaner.

In the related art, a handheld vacuum cleaner has been disclosed in EP-A 3488750 and Korean Patent No. 10-1127088.

The handheld vacuum cleaner includes a suction pipe, an airflow generator, a cyclone, a power supply, and a handle.

In particular, the airflow generator of a handheld cleaner disclosed in Korean Patent No. 10-1127088 is disposed in a motor housing and has an assembly of a motor and a fan. Further, a pre motor filter is disposed ahead of the motor and a post motor filter is disposed behind the motor.

At this time, when the filters are used for a long period of time, dust may be accumulated in the filters, when the filters are not cleaned, the dust accumulating in the filters acts as flow resistance, thereby deteriorating suction ability.

However, in this case, since the pre motor filter is disposed between the airflow generator and the cyclone and surrounded by a housing at the outside, and it is required to disassemble the product in order to reach and clean the filters, and it is troublesome to a user.

SUMMARY

The present disclosure was invented to solve the above problem, and the object thereof is to provide a vacuum cleaner capable of easily separating the filter module from the main body, and separating the filter module separated from the body again and reassembling it, such that the filter disposed inside the filter module may be easily cleaned.

Further, according to the present disclosure, the object of the present disclosure is to provide a cleaner capable of separately replacing only a filter provided inside the filter module by easily separating and assembling the filter module.

In order to achieve the above object, in a cleaner according to a preferred embodiment of the present disclosure, a filter module is detachable from a main body, and in particular, the filter module separated from the main body may be formed to be separable and assemblable so as to clean or replace a filter provided therein.

One embodiment is a cleaner including: a main body; a suction motor disposed in the main body and configured to generate a suction force so as to suction air; a dust separator configured to separate dust from air by generating a cyclone flow in air introduced by the suction motor; and a filter module having a filter configured to filter air discharged from the suction motor and being detachable from the main body.

In particular, the filter module may be made to be separated and assembled such that the filter provided therein is washable or replaceable.

Here, the filter module may include: a lower filter housing detachably fastened to the main body; a filter accommodated in the lower filter housing; an upper filter housing fastened to the lower filter housing and having air exits through which air passing through the filter is discharged; and a fastening portion provided in the lower filter housing and selectively fastening and fixing the upper filter housing.

Here, as a first embodiment, the fastening portion may have one end in which an accommodating groove allowing a hook portion formed on an inner surface of the upper filter housing to be inserted thereinto is formed, and another end integrally provided in the lower filter housing so as to be elastically bent and deformed by an external force.

In addition, the accommodating groove may be formed to restrain the upper filter housing from being rotated relative to or separated from the lower filter housing in a state in which the hook portion is inserted thereinto.

In addition, the fastening portion may be formed by cutting one area of an outer wall of the lower filter housing.

In addition, the fastening portion according to a second embodiment may be formed by including a pressing member provided to move in a radial direction in the lower filter housing and having an accommodating groove into which the hook portion formed on an inner surface of the upper filter housing is inserted; and an elastic member disposed between the lower filter housing and the pressing member and applying an elastic force such that the pressing member moves outward in a radial direction.

Here, the pressing member may include: a pressing member body disposed to be moved between an outer wall and an inner wall of the lower filter housing, and having the accommodating groove formed at a portion overlapping the upper filter housing; and a guide protrusion protruding from the pressing member body toward the inner wall and being inserted into a slit groove formed in the inner wall to guide movement.

In addition, the pressing member further may include: a locking protrusion protruding from the pressing member body toward the upper filter housing and supported by a locking jaw formed on the lower filter housing to prevent the locking protrusion from escaping outward; and a restricting groove supported by the locking protrusion protruding from the inner wall to restrict inward movement when the pressing member body is moved inward.

The elastic member may be formed to have one end inserted into a first elastic member accommodating groove formed in the inner wall of the lower filter housing and fixed in position, and another end inserted into a second elastic member accommodating groove formed in the pressing member and fixed in position.

According to the embodiment of the present disclosure, in the filter module, the upper filter housing may be inserted into an insertion portion formed to have a smaller thickness at an upper end of the lower filter housing and be coupled to each other so as to be rotatable relative to each other, and the upper filter housing is fastened to the lower housing by the fastening portion in one area thereof.

Further, the filter module may further include stoppers coupled to each other only at a fastening position such that a fastening position where the upper filter housing is fastened by the fastening portion in one area is recognized.

More specifically, the stopper may include: a stopper protrusion protruding outward from the insertion portion of the lower filter housing and spaced apart from the fastening portion by a certain angle; and a stopper insertion groove formed on an inner surface of the upper filter housing to allow the stopper protrusion to be inserted thereinto and spaced apart from the hook portion formed on an inner surface of the upper filter housing by a certain angle.

Here, in the stopper, the stopper protrusion may be separated from the stopper insertion groove when the lower filter housing and the upper filter housing are rotated relative to each other by a certain rotational force or more.

For example, the stopper protrusion may be formed by a circular protrusion and a triangular protrusion spaced apart from each other in a circumferential direction, and a base of the triangular protrusion is disposed toward the circular protrusion; and the stopper insertion groove may be formed in a shape corresponding to the circular protrusion and the triangular protrusion such that the circular protrusion and the triangular protrusion are respectively inserted thereinto.

Further, the lower filter housing may include: a filter cover provided in a ring shape, having a plurality of through holes through which air flows, and having a rib coupling portion formed to be detachable from a fixing rib formed in the main body; an inner wall disposed to protrude in a direction perpendicular to an inner diameter of the filter cover; and an outer wall disposed to protrude in a direction perpendicular to an outer diameter of the filter cover.

Here, the filter may be accommodated between the inner wall and the outer wall.

According to the embodiment of the present disclosure, the filter module may include: a first sealing portion fastened to the upper filter housing and sealing such that air does not leak between the upper filter housing and the lower filter housing; and a second sealing portion fastened to the lower filter housing and closely coming in contact with an inner circumferential surface of the main body to seal air so as not to leak through a gap between the lower filter housing and the main body.

More specifically, the first sealing portion may include: a sealing portion body formed in a ring shape; a first sealing member protruding radially outward from one end of the sealing portion body and fitted and fastened between the upper filter housing and the lower filter housing; a second sealing member protruding radially outward from another end of the sealing portion body and disposed to face an inner circumferential surface of the lower filter housing; and a fastening member protruding vertically from the first sealing member and inserted into and fastened to a fastening groove formed in the upper filter housing.

According to the cleaner according to the present disclosure, the filter module may be easily separated from the main body of the cleaner, and the filter disposed inside the filter module may be completely exposed to the outside by separating the separated filter module again, such that the filter disposed inside the filter module may be easily cleaned.

In addition, according to the present disclosure, the present disclosure aims to provide a cleaner capable of reducing costs of maintenance and repair by allowing the filter module to be easily separated and assembled such that only the filter provided inside the filter module can be replaced separately.

MODE FOR INVENTION

Figure 1:
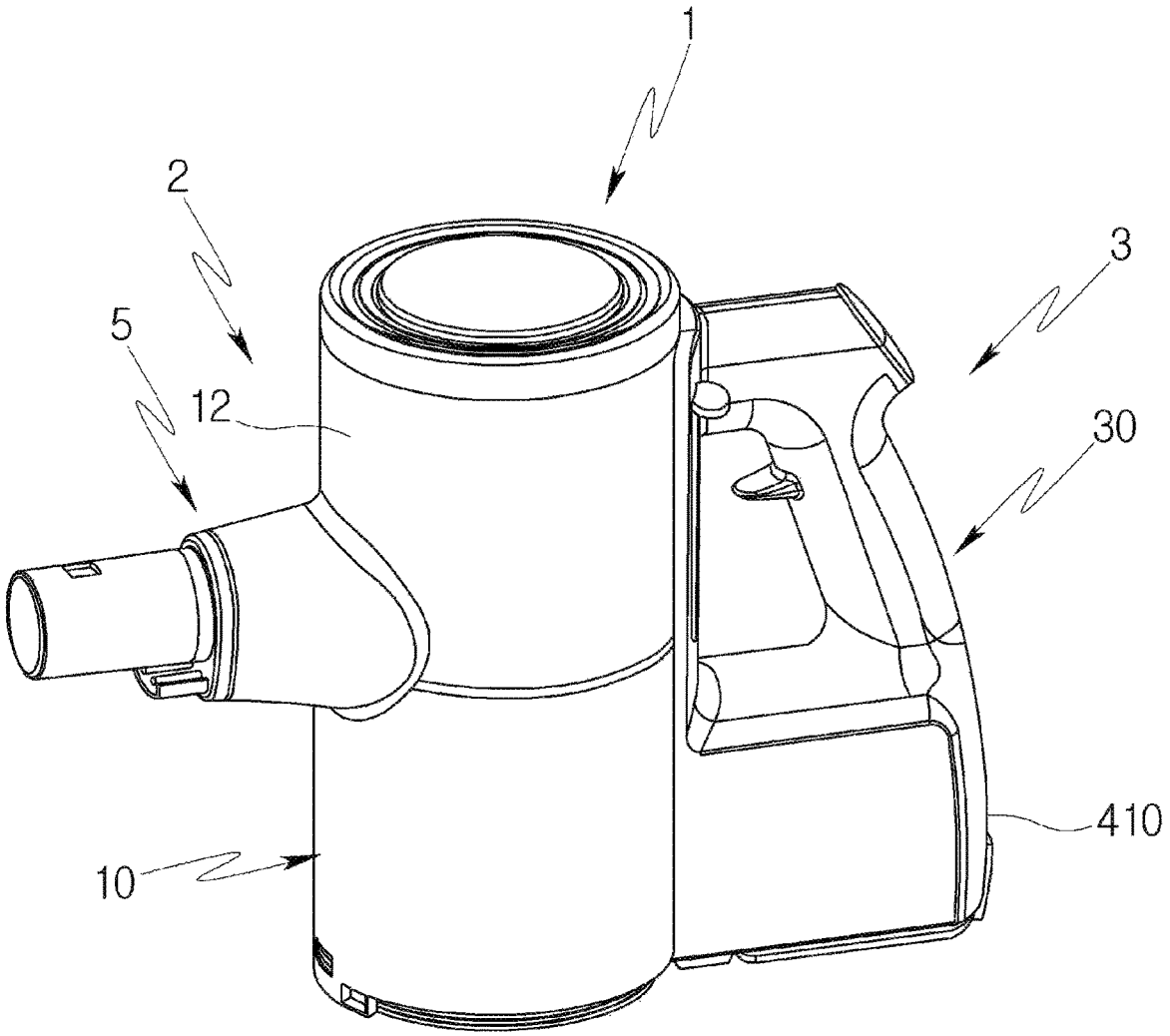
FIG. 1 is a schematic perspective view illustrating a cleaner according to an embodiment of the present disclosure.

Hereinafter, exemplary embodiments of the present disclosure will be described in further detail with reference to the accompanying drawings.

While the present disclosure is susceptible to various modifications and alternative forms, specific embodiments are shown by way of example in the drawings and described in detail. It should be understood, however, that the description is not intended to limit the present invention to the specific embodiments, but, on the contrary, the present disclosure is to cover all modifications, equivalents, and alternatives that fall within the spirit and scope of the present disclosure.

Terms used in the specification, 'first', 'second', etc. can be used to describe various components, but the components are not to be construed as being limited to the terms. The terms are only used to differentiate one component from other components. For example, the 'first' component may be named the 'second' component without departing from the scope of the present disclosure, and the 'second' component may also be similarly named the 'first' component.

The term 'and/or' includes a combination of a plurality of items or any one of a plurality of terms.

Stating that one component is "connected" or "joined" to another should be understood as meaning that the one component may be directly connected or joined to another one or another constituent may be interposed between the components. Further, stating that one component is "directly connected" or "directly joined" to another should be understood as meaning that no other component is interposed between the components.

The terms used in the present specification are merely used to describe specific embodiments and are not intended to limit the present disclosure. A singular expression includes a plural expression unless a description to the contrary is specifically pointed out in context.

In the present specification, it should be understood that the terms such as "include/comprise" or "have" are merely intended to indicate that features, numbers, steps, operations, components, parts, or combinations thereof are present, and are not intended to exclude the possibility that one or more other features, numbers, steps, operations, components, parts, or combinations thereof will be present or added.

Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the related art and will not be interpreted in an idealized or overly formal sense unless expressly so defined herein.

In addition, the embodiments of the present disclosure below are provided to more fully explain the present disclosure to those having ordinary knowledge in the art to which the present disclosure pertains, and shapes, sizes, and the like of components in the drawings may be exaggerated for clarity of illustration.

Hereinafter, exemplary embodiments of the present disclosure will be described in further detail with reference to the accompanying drawings.

Figure 2:
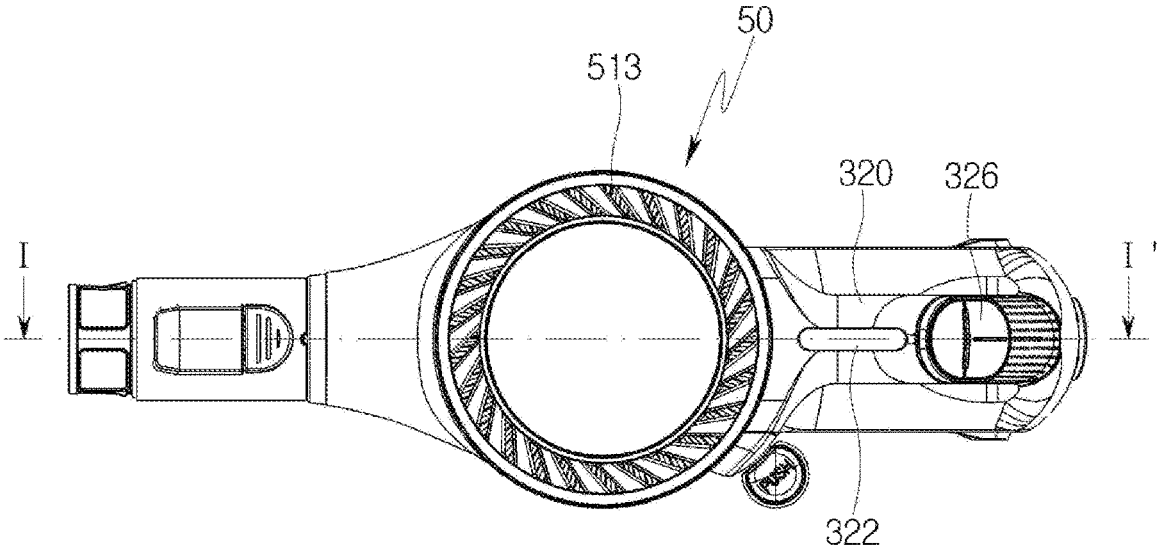
FIG. 2 is a schematic plan view illustrating the cleaner according to an embodiment of the present disclosure.
Figure 3:
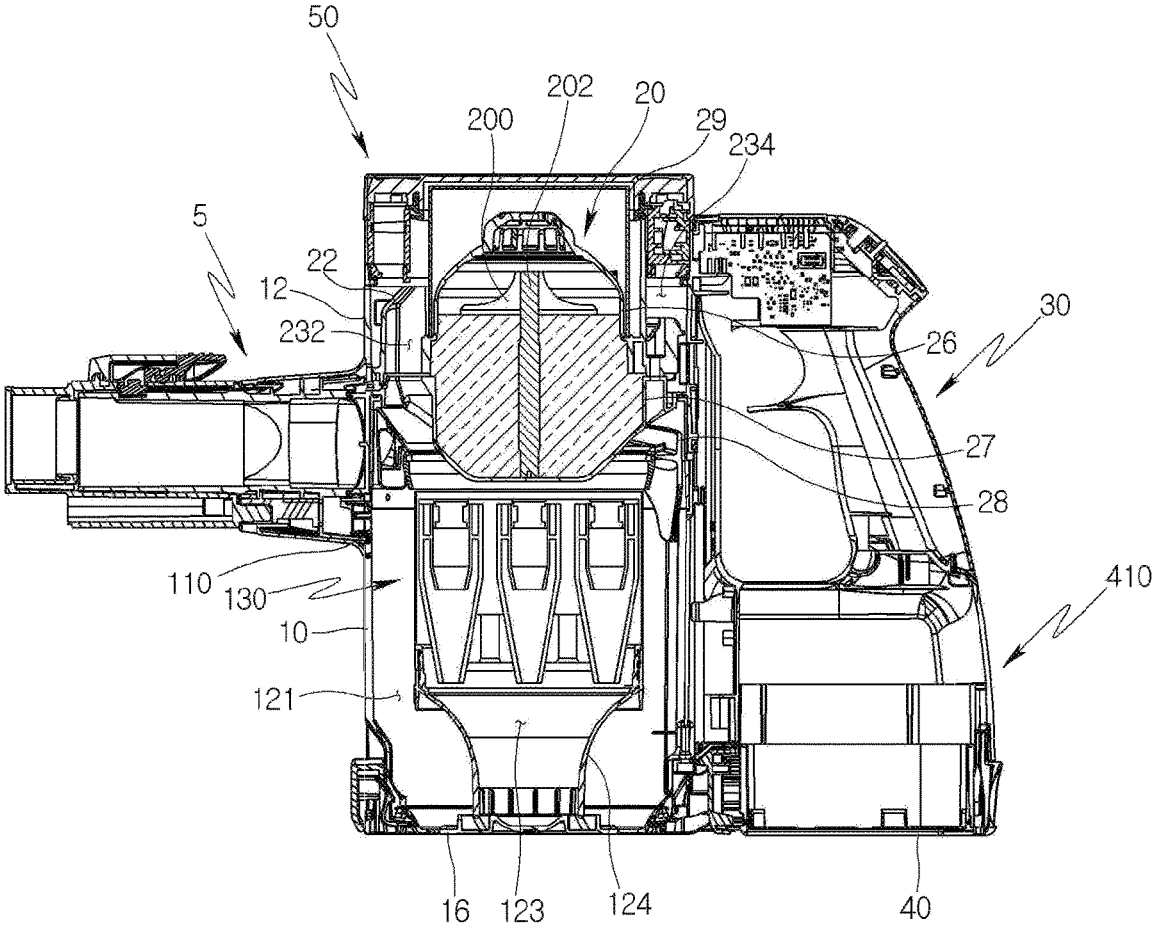
FIG. 3 is a schematic cross-sectional view illustrating a cross section obtained by cutting a region along line I-I' of FIG. 2.

FIGS. 1 and 2 are a schematic perspective view and a schematic plan view illustrating a cleaner according to an embodiment of the present disclosure, and FIG. 3 is a schematic cross-sectional view illustrating a cross section obtained by cutting a region along line I-I' of FIG. 2.

Referring to FIGS. 1 to 3, a cleaner 1 according to an embodiment of the present disclosure may include a main body 2.

The cleaner 1 may further include a suction unit 5 coupled to the front of the main body 2. The suction unit 5 may guide air containing dust to the main body 2.

The cleaner 1 may further include a handle unit 3 coupled to the main body 2. The handle unit 3 may be positioned opposite to the suction unit 5 on the main body 2.

That is, the main body 2 may be disposed between the suction unit 5 and the handle unit 3.

The main body 2 may include a first body 10 and a second body 12 on the first body 10. The first body 10 and the second body 12 may be directly combined or may be indirectly combined through an intermediate member.

The first body 10 and the second body 12 may be, though not limited thereto, formed in a cylindrical shape.

The first body 10 and the second body 12 are open at the top and the bottom, respectively. That is, the bodies 10 and 12 may have a top opening and a bottom opening, respectively.

In addition, the suction unit 5 may be coupled to the main body 2 such that the center of the suction unit 5 is positioned approximately at the boundary between the first body 10 and the second body 12.

The main body 2 may further include a dust separation unit that separates dust from air sucked through the suction unit 5.

The dust separation unit may include a first cyclone unit 110 that may separate dust, for example, using cyclonic flow. The first body 10 includes the first cyclone unit 110 in this configuration.

The air and dust sucked through the suction unit 5 helically flow along the inner side of the first cyclone unit 110.

The axis of the cyclonic flow in the first cyclone unit 110 may vertically extend.

The dust separation unit may further include a second cyclone unit 130 that secondarily separates dust from the air discharged out of the first cyclone unit 110. The second cyclone unit 130 may be disposed inside the first cyclone unit 110 to minimize the size of the dust separation unit. The second cyclone unit 190 may include a plurality of cyclone bodies arranged in a row.

As another example, the dust separation unit may include one cyclone unit, in which the axis of the cyclonic flow may also vertically extend.

The first body 10 functions as a dust container that stores dust separated by the cyclone units 110 and 130.

The main body 2 may further include a body cover 16 for opening/closing the bottom of the first body 10. The body cover 16 may open/close the first body 10 by being rotated.

At least a portion of the second cyclone unit 190 may be positioned inside the first body 10.

A dust storage guide 124 that guides the dust separated by the second cyclone unit 130 to be stored may be disposed in the first body 10. The dust storage guide 124 may be coupled to the bottom of the second cyclone unit 130 in contact with the top of the body cover 16.

The dust storage guide 124 may divide the internal space of the first body 10 into a first dust storage part 121 where the dust separated by the first cyclone unit 110 is stored and a second dust storage part 123 where the dust separated by the second cyclone unit 130 is stored.

The internal space of the dust storage guide 124 is the second dust storage part 123 and the space between the dust storage guide 124 and the first body 10 is the first dust storage part 121.

The body cover 16 may open/close both of the first dust storage part 121 and the second dust storage part 123.

The cleaner 1 may further include a suction motor 20 for generating a suction force and a battery 40 for supplying power to the suction motor 20.

The suction motor 20 may be disposed in the second body 12. At least a portion of the suction motor 20 may be disposed over the dust separation unit.

Accordingly, the suction motor 20 is disposed over the first body 10.

The suction motor 20 may communicate with an outlet of the second cyclone unit 130.

To this end, the main body 2 may further include a discharge guide 28 connected to the second cyclone unit 130 and a flow guide 22 that communicates with the discharge guide 28.

For example, the discharge guide 28 is disposed on the second cyclone unit 130 and the flow guide 22 is disposed over the discharge guide 28.

Further, at least a portion of the suction motor 20 is positioned inside the flow guide 22.

Accordingly, the axis of the cyclonic flow in the dust separation unit may pass through the suction motor 20.

When the suction motor 20 is disposed over the second cyclone unit 130, the air discharged from the second cyclone unit 130 may flow directly to the suction motor 20, so the flow path between the dust separation unit and the suction motor 20 may be minimized.

The suction motor 20 may include a rotary impeller 200. The impeller 200 may be fitted on a shaft 202. The shaft 202 is vertically disposed.

Further, the suction motor 20 may be arranged such that the impeller 200 is positioned at an upper portion of the suction motor 20.

In this case, air may flow from an upper portion to a lower portion of the suction motor 20 by the impeller 200.

The rotational axis of the impeller 200 and the axis of the cyclonic flow in the first cyclone unit 110 may be on the same line.

According to the present disclosure, there is the advantage that the path through which the air discharged from the dust separation unit, that is, the air discharged upward from the second cyclone unit 130 flows to the suction motor 20 may be reduced and a change in direction of air may be decreased, so a loss of airflow may be reduced.

As the loss of airflow is reduced, a suction force may be increased and the lifetime of the battery 40 for supplying power to the suction motor 20 may be increased.

The cleaner 1 may further include an upper motor housing 26 covering a portion of the top of the suction motor 20 and a lower motor housing 27 covering a portion of the bottom of the suction motor 20. The suction motor 20 may be disposed inside the motor housings 26 and 27 and the flow guide 22 may be disposed to cover the upper motor housing 26.

At least a portion of the flow guide 22 may be spaced apart from the upper motor housing 26. Further, at least a portion of the flow guide 22 may be spaced apart from the second body 12.

Accordingly, a first air passage 232 is formed by the inner side of the flow guide 22 and the outer side of the upper motor housing 26 and a second air passage 234 is formed by the outer side of the flow guide 22 and the inner side of the second body 12.

According to the present disclosure, there is the advantage of simplifying the structure in that the single flow guide 22 forms the first air passage 232 and the second air passage 234, and the number of parts for forming each air passage can be reduced.

The first air passage 232 functions as an intake channel, and the second air passage 234 functions as an exhaust channel.

The air discharged from the second cyclone unit 190 flows to the suction motor 20 through the first air passage 232 and the air discharged from the suction motor 20 flows through the second air passage 234 and is then discharged outside. Accordingly, the first air passage 232 functions as an intake channel and the second air passage 234 functions as an exhaust channel.

The handle unit 3 may include a handle 30 for a user to hold and a battery housing 410 under the handle 30.

The handle 30 may be disposed behind the suction motor 20.

As for directions, with respect to the suction motor 20 in the cleaner 1, the direction in which the suction unit 5 is positioned is the front direction and the direction in which the handle 30 is positioned is the rear direction.

The battery 40 may be disposed behind the first body 10. Accordingly, the suction motor 20 and the battery 40 may be arranged not to vertically overlap each other and may be disposed at different heights.

According to the present disclosure, since the suction motor 20 that is heavy is disposed ahead of the handle 30 and the battery 40 that is heavy is disposed behind the handle 30, so weight may be uniformly distributed throughout the cleaner 1. It is possible to prevent injuries to the user's wrist when a user cleans with the handle 30 in his/her hand. That is, since the heavy components are distributed at the front and rear portions and at different heights in the cleaner 1, it is possible to prevent the center of gravity of the cleaner 1 from concentrating on any one side.

Since the battery 40 is disposed under the handle 30 and the suction motor 20 is disposed in front of the handle 30, there is no component over the handle 30. That is, the top of the handle 30 forms a portion of the external appearance of the top of the cleaner 1.

Accordingly, it is possible to prevent any component of the cleaner 1 from coming in contact with the user's arm while the user cleans with the handle 30 in his/her hand.

The handle 30 may include a first extension 310 extending vertically to be held by a user and a second extension 320 extending toward the suction motor 20 over the first extension 310. The second extension 320 may at least partially horizontally extend.

A movement limiting portion 312 for preventing a user's hand holding the first extension 310 from moving in the longitudinal direction of the first extension 310 (vertically in FIG. 2) may be formed on the first extension 310. The movement limiting portion 312 may extend toward the suction unit 5 from the first extension 310.

The movement limiting portion 312 is spaced apart from the second extension 320. Accordingly, a user is supposed to hold the first extension 310, with some of the fingers over the movement limiting portion 312 and the other fingers under the movement limiting portion 312.

For example, the movement limiting portion 312 may be positioned between the index finger and the middle finger.

The handle 30 may include an operation unit 326. For example, the operation unit 326 may be disposed on an inclined surface of the second extension 320. It is possible to input instructions to turn on/off the cleaner (suction motor) through the operation unit 326.

The operation unit 326 may be disposed to face a user. The operation unit 326 may be disposed opposite to the movement limiting portion 312 with the handle 30 therebetween.

The operation unit 326 is positioned higher than the movement limiting portion 312. Accordingly, a user may easily operate the operation unit 326 with his/her thumb with the first extension 310 in his/her hand.

Further, since the operation unit 326 is positioned outside the first extension 310, it is possible to prevent the operation unit 326 from being unexpectedly operated when a user cleans with the first extension 310 in his/her hand.

A display unit 322 for showing operational states may be disposed on the second extension 320. The display unit 322 may be, for example, disposed on the top of the second extension 320. Accordingly, a user can easily check the display unit 322 on the top of the second extension 320 while cleaning. The display unit 322 may display, for example, the remaining capacity of the battery 40, the intensity of the suction motor and the like.

The battery housing 410 may be disposed under the first extension 310.

The battery 40 may be detachably combined with the battery housing 410. For example, the battery 40 may be inserted into the battery housing 410 from under the battery housing 410.

The rear side of the battery housing 410 and the rear side of the first extension 310 may form a continuous surface. Accordingly, the battery housing 410 and the first extension 310 may be shown like a single unit.

Referring to FIG. 2, the cleaner 1 may further include a filter module 50 having air exits 513 for discharging the air that has passed through the suction motor 20. For example, the air exits 513 may include a plurality of openings and the openings may be circumferentially arranged. Accordingly, the air exits 513 may be arranged in a ring shape.

The filter module 50 may be detachably coupled to the top of the main body 2. That is, the filter module 50 may be detachably coupled to the second body 12.

When the filter module 50 is combined with the main body 2, a portion of the filter unit 50 is positioned outside the second body 12. Accordingly, a portion of the filter module 50 is inserted in the main body 2 through the open top of the main body 2 and the other portion protrudes outside from the main body 2.

The height of the main body 2 may be substantially the same as the height of the handle 30. Accordingly, the filter module 50 protrudes upward from the main body 2, so a user may easily hold and separate the filter module 50.

When the filter module 50 is combined with the main body 2, the air exits 513 are positioned at the upper portion of the filter module 50. Accordingly, the air discharged from the suction motor 20 is discharged upward from the main body 2.

According to this embodiment, it is possible to prevent the air discharged from the air exits 513 from flowing to a user while the user cleans using the cleaner 1.

The main body 2 may further include a pre-filter 29 for filtering the air flowing into the suction motor 20. The pre-filter 29 may be disposed inside the flow guide 22. Further, the pre-filter 29 is seated over the upper motor housing 26 and may surround a portion of the upper motor housing 26. That is, the upper motor housing 26 may include a filter support for supporting the pre-filter 29.

In a state where the filter module 50 is mounted on the main body 2, the filter module 50 may pressurize the pre-filter 29 to prevent displacement of the pre-filter 29.

For example, the filter module 50 may press the pre-filter 29 downward. Therefore, according to the present disclosure, there is an advantage in that a structure for fixing the pre-filter 29 is unnecessary.

Figure 4:
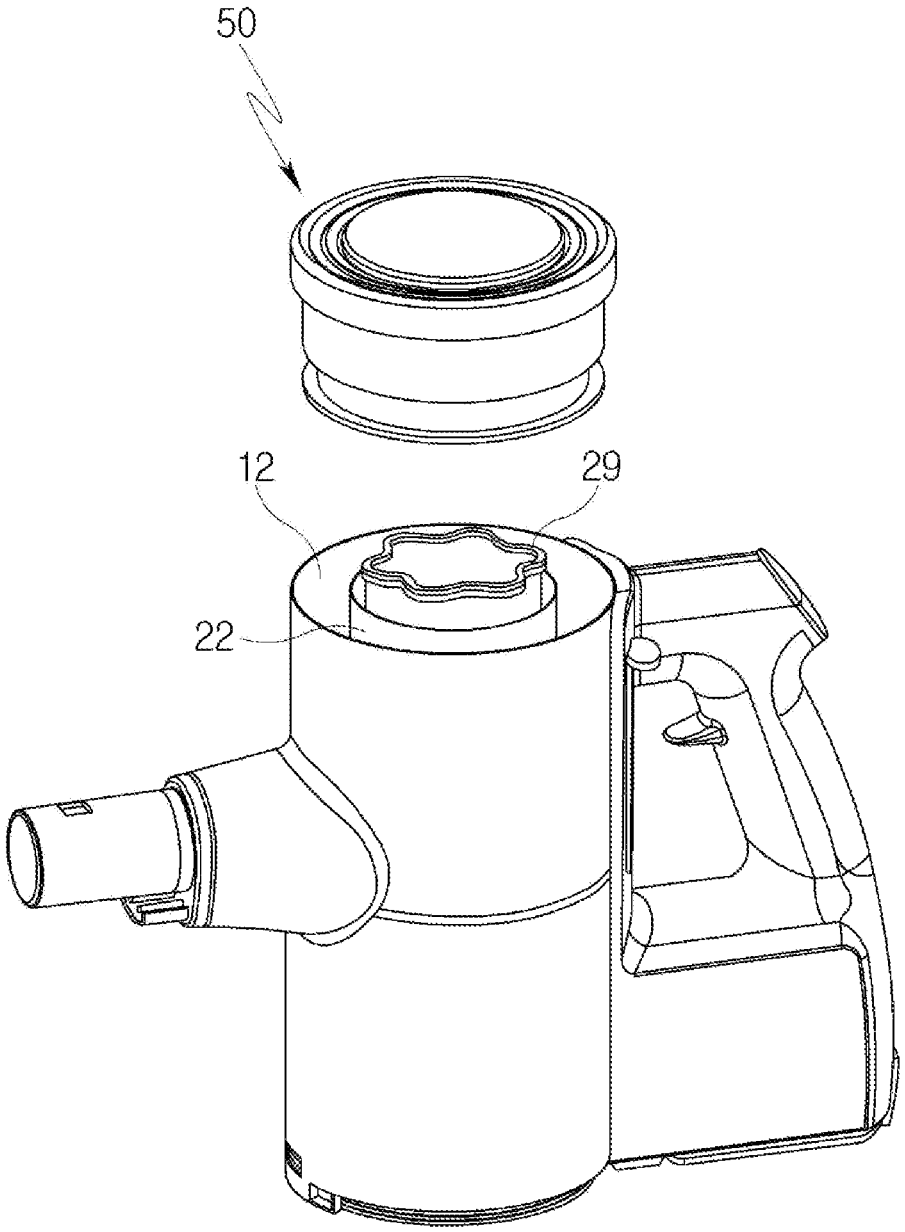
FIG. 4 is a schematic perspective view illustrating a state in which the filter module is separated from the cleaner according to an embodiment of the present disclosure.
Figure 5:
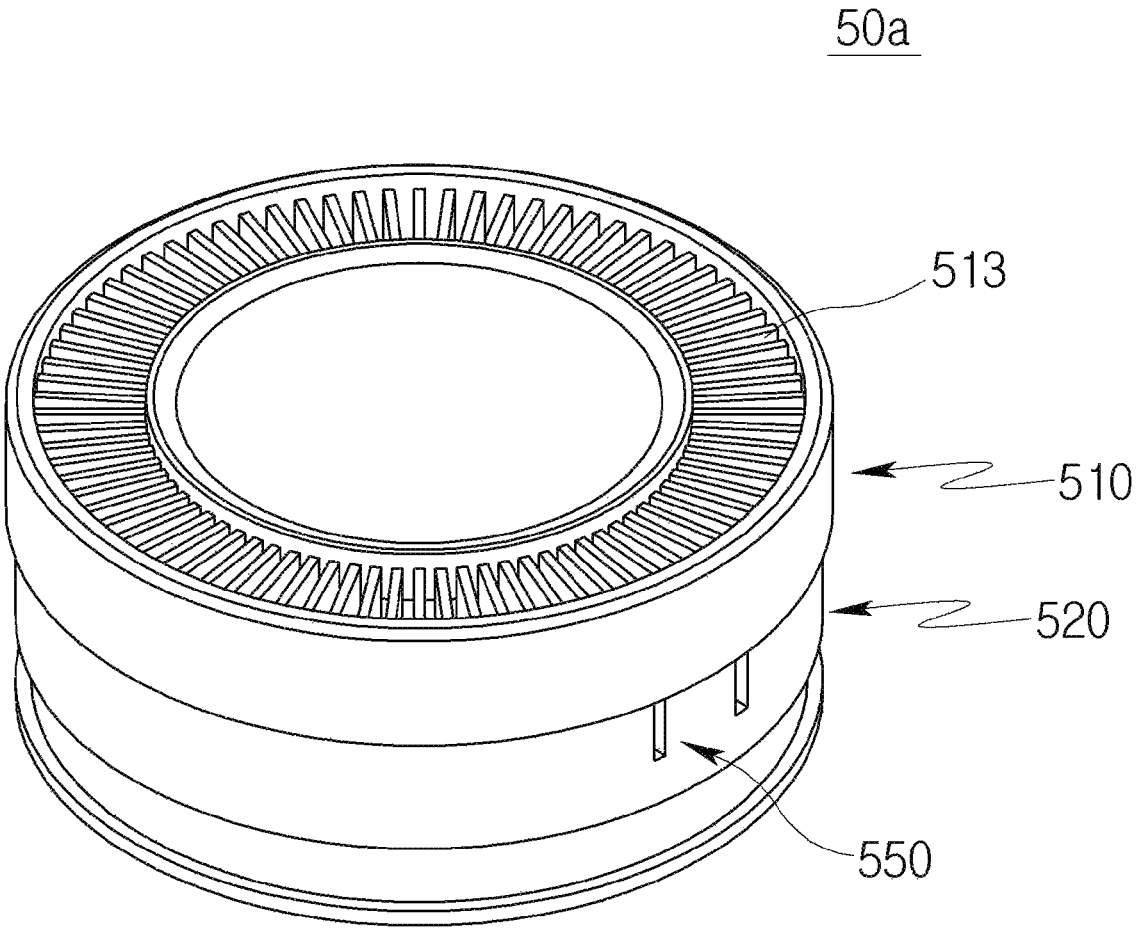
FIG. 5 is a schematic perspective view illustrating the filter module according to the first embodiment, which is taken from the cleaner according to an embodiment of the present disclosure.
Figure 6:
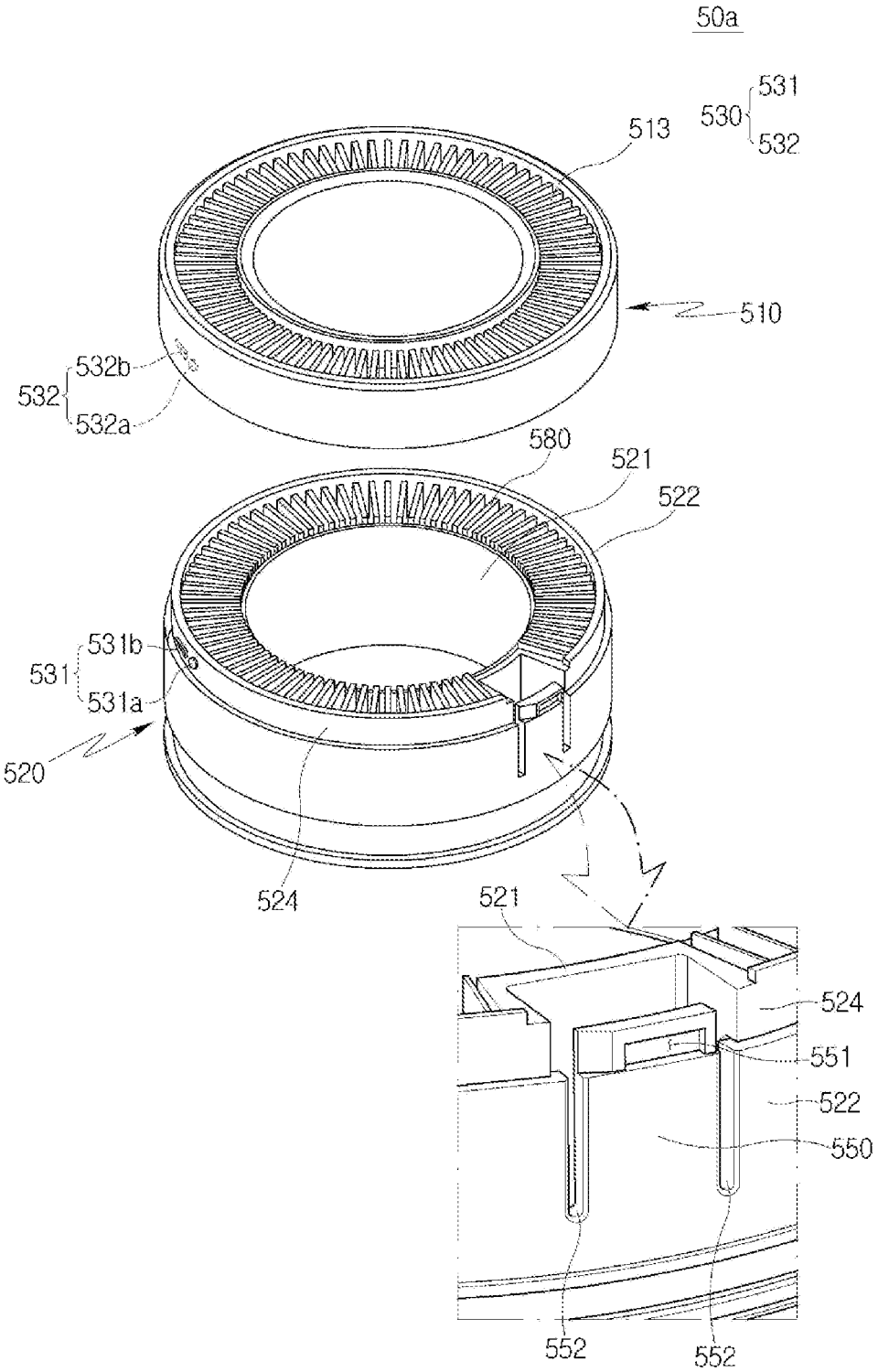
FIG. 6 is a schematic exploded perspective view illustrating the filter module according to the first embodiment of the cleaner according to an embodiment of the present disclosure.
Figure 7:
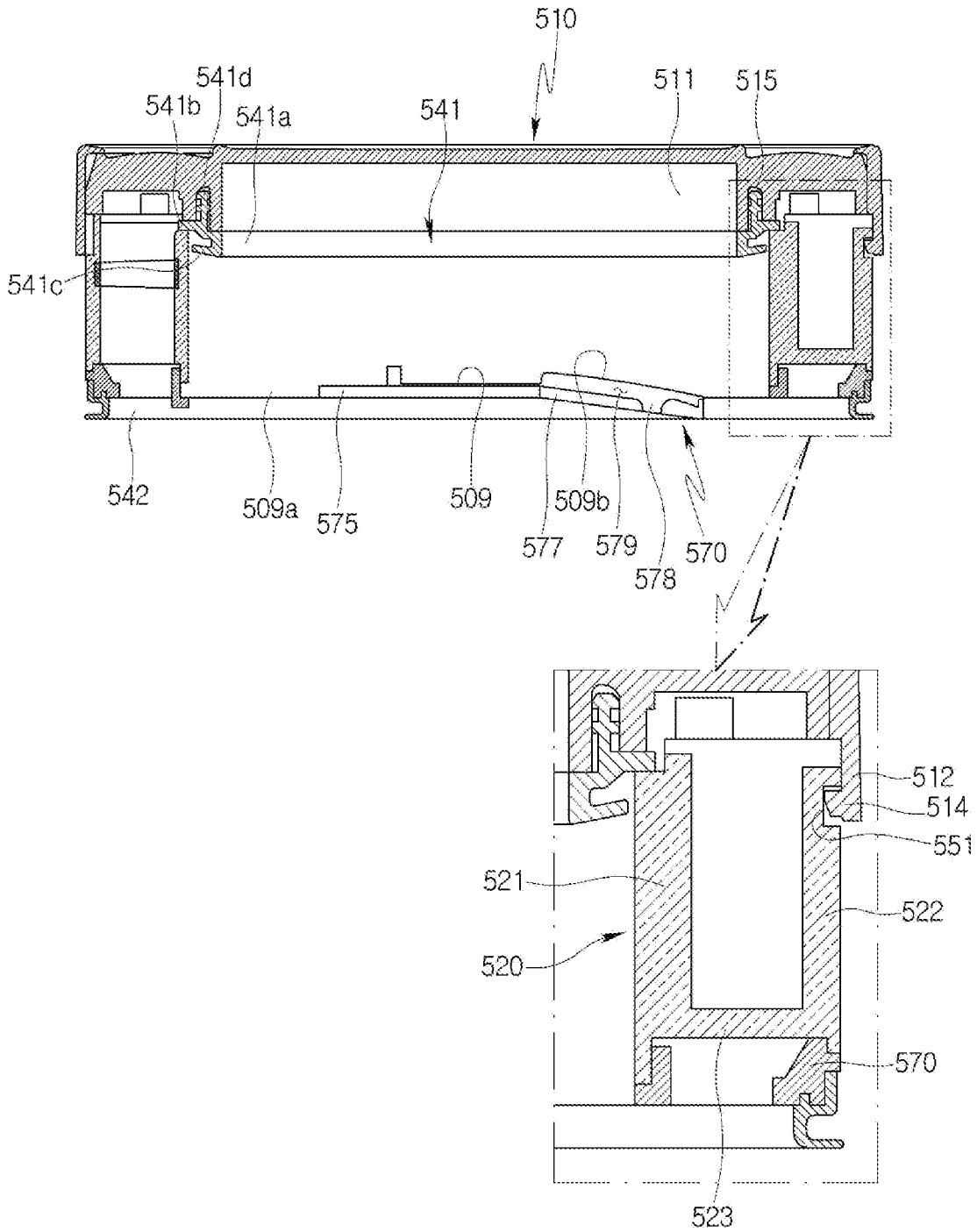
FIG. 7 is a schematic cross-sectional view illustrating the filter module according to the first embodiment of the cleaner according to an embodiment of the present disclosure.
Figure 8:
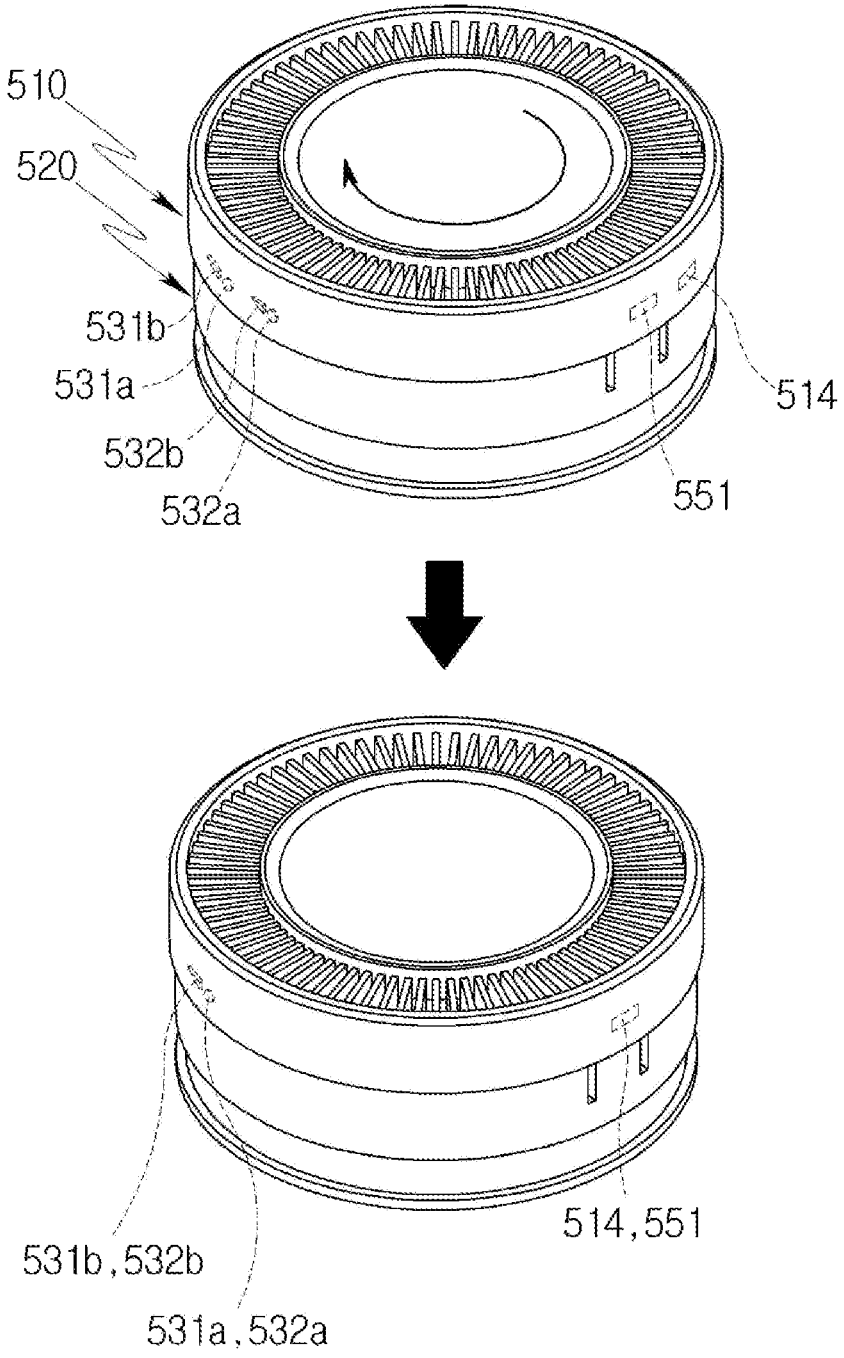
FIG. 8 is a schematic perspective view illustrating the coupling operation of the filter module according to the first embodiment of the cleaner according to an embodiment of the present disclosure.

FIG. 4 is a schematic perspective view illustrating a state in which the filter module is separated from the cleaner according to the embodiment of the present disclosure, FIGS. 5 to 7 are a schematic perspective view, exploded perspective view, and cross-sectional view schematically illustrating the filter module according to the first embodiment, and FIG. 8 is a schematic perspective view illustrating the coupling operation of the filter module according to the first embodiment.

Referring to FIGS. 4 to 8, the filter module 50 according to the first embodiment of the present disclosure is disposed to surround the pre-filter 29, has a filter 580 that filters the air discharged from the suction motor 20, and may be detachable from the main body 2.

Further, the filter module 50 may be separated and assembled such that the filter 580 provided therein may be washed or replaced. That is, the filter module 50 may be separated from the main body 2, and the filter module 50 itself is configured to be separated and assembled such that after separating the filter module 50, the filter placed inside the filter module 50 may be easily cleaned or replaced, and the filter module 50 separated may be reassembled.

More specifically, the filter module 50 may include a lower filter housing 520 detachably fastened to the main body 2, the filter 580 accommodated in the lower filter housing 520, and an upper filter housing 510 fastened to the lower filter housing 520 and having air exits 513 for discharging air that has passed through the filter 580, and a fastening portion 550 provided in the lower filter housing 520 and to which the upper filter housing 510 is selectively fastened and fixed.

The filter 580 may be, for example, a high efficiency particulate air filter (HEPA filter).

The filter 580 may be disposed to surround the flow guide 22 such that the height of the cleaner 1 is prevented from being increased in a state where the filter module 50 is combined with the main body 2.

That is, the filter 580 may be formed in a ring shape, for example, and a portion of the flow guide 22 may be positioned in an area formed by the filter 580.

In addition, at least a portion of the pre-filter 29 may be accommodated in an area formed by the filter 580. That is, the filter 580 may be disposed to surround the pre-filter 29.

The lower filter housing 520 may include a filter cover 570, an inner wall 521, and an outer wall 522.

The filter cover 570 may be formed in a ring shape, has a plurality of openings 574 to allow air to flow therethrough, and have a rib coupling portion 577 detachable from a fixing rib 228 formed in the main body 2.

The inner wall 521 protrudes in a direction perpendicular to the inner diameter of the filter cover 570, and the outer wall 522 protrudes in a direction perpendicular to the outer diameter of the filter cover 570.

That is, the inner wall 521 and the outer wall 522 are arranged to have concentricity, and the outer wall 522 is arranged to surround the inner wall 521.

The filter 580 is accommodated in a space formed between the inner wall 521 and the outer wall 522.

In addition, the inner wall 521 and the outer wall 522 may be integrally formed by a plurality of connection members 523 spaced apart from the lower ends in the circumferential direction at regular intervals. Here, air may pass between the connecting members 523. It is not limited thereto, and the inner wall 521 and the outer wall 522 may be integrally formed with the filter cover 570.

The upper filter housing 510 is inserted into the insertion portion 524 formed to have a smaller thickness at the upper end of the outer wall 522 of the lower filter housing 520 and is coupled to each other so as to be rotatable relative to each other, and the upper filter housing 510 is fastened to the lower filter housing 520 by the fastening portion 550 in one area.

The upper filter housing 510 has a cylindrical shape, is disposed above the lower filter housing 520, and closes the central region of the open upper side of the lower filter housing 520, and the air exit 513 may be formed at the radially outer portion of the lower filter housing 510 so as to allow air to pass therethrough.

For example, the air exits 513 may include a plurality of openings and the openings may be circumferentially arranged. Accordingly, the air exit 513 may be arranged in a ring shape.

The air exits 513 may be formed in a size corresponding to a space between the inner wall 521 and the outer wall 522 of the lower filter housing 520 to allow air that has passed through the filter 580 to be discharged therethrough.

In addition, the upper filter housing 510 may include an inner partition wall 511 disposed to face the inner wall 521 of the lower filter housing 520 and an outer partition wall 512 disposed to face the outer wall 522 of the lower filter housing 520.

Accordingly, the air exit 513 may be formed between the inner partition wall 511 and the outer partition wall 512.

Further, a hook portion 514 is formed radially inward on an inner surface of the outer partition wall 512 of the upper filter housing 510 and is selectively fastened to the fastening portion 550. The hook portion 514 is formed only in one area of the inner surface of the outer partition wall 512 of the upper filter housing 510, such that the hook portion 514 can be fastened only when being placed at a position corresponding to the fastening portion 550.

The fastening portion 550 has an accommodating groove 551 into which the hook portion 514 formed in the inner partition wall 511 of the upper filter housing 510 is inserted formed at one end, and the other end thereof may be integrally provided in the lower filter housing 520 so as to be elastically bent and deformed by an external force.

For example, the fastening portion 550 may be formed by cutting one area of the outer wall 522 of the lower filter housing 520. That is, when two incisions 552 are formed in the outer wall 522, a space between the two incisions 552 may become the fastening portion 550.

The fastening portion 550 is configured in the form of a cantilever having a free end, and is elastically bent inward when a user presses the fastening portion 550 from the outside, and can return to its original position when an external force is removed.

That is, when an external force is applied, the accommodating groove 551 is separated from the hook portion 514 by being bent inward, and the upper filter housing 510 may be separated from the lower filter housing 520.

The accommodating groove 551 may be formed to restrict the upper filter housing 510 from being rotated relative to or separated from the lower filter housing 520 in a state in which the hook portion 514 is inserted into the accommodating groove 551.

That is, the accommodating groove 551 is formed such that the hook portion 514 can be inserted in a form completely enclosing the accommodating groove 551, so that the movement of the hook portion 514 may be restricted in a state where the hook portion 514 is inserted into the accommodating groove 551.

Further, the filter module 50 may further include stoppers 530 that are fastened to each other only at a fastening position such that the fastening position where the upper filter housing 510 is fastened by the fastening portion 550 in one area can be recognized.

That is, the stoppers 530 are formed in the upper filter housing 510 and the lower filter housing 520, respectively, at different positions from the fastening portion 550, and the fastening portion 550 is formed to be inserted into the accommodating groove 551 at a position where the stoppers 530 are hooked up.

To this end, the stopper 530 may include stopper protrusions 531 and stopper insertion grooves 532.

More specifically, the stopper protrusions 531 may protrude outward from the insertion portion 524 of the lower filter housing 520 and may be spaced apart from the fastening portion 550 by a certain angle.

In addition, the stopper insertion grooves 532 may be formed such that the stopper protrusions 531 are inserted into the stopper insertion grooves 532 on the inner surface of the upper filter housing 510, and may be formed spaced apart by a certain angle from the hook portion 514 formed on the inner surface of the upper filter housing 510.

Here, the angle by which the stopper protrusion 531 is spaced apart from the fastening portion 550 and the angle by which the stopper insertion groove 532 is spaced apart from the hook portion 514 are formed to be the same, such that the hook portion 514 is inserted into the accommodating groove 551 of the fastening portion 550 at a position where the stopper protrusion 531 is inserted into the stopper insertion groove 532.

Thereby, when assembling the upper filter housing 510 and the lower filter housing 520, which are separated, referring to FIG. 8, in a state where the lower filter housing 520 is inserted into the upper filter housing 510 by the user without considering the position, the user slowly rotates the upper filter housing 510 and the lower filter housing 520 and recognizes a position where the user feels a sense of fastening that the stopper projection 531 is inserted into the stopper insertion groove 532, and the fastening is completed as the hook portion 514 is inserted into the accommodating groove 551.

Further, as for the stopper 530, the stopper projection 531 is configured to disengage from the stopper insertion groove 532 when the lower filter housing 520 and the upper filter housing 510 are rotated relative to each other by a certain rotational force or higher.

That is, when the upper filter housing 510 and the lower filter housing 520 are separated, the user presses the fastening portion 550 to disengage the hook portion 514 from the accommodating groove 551 of the fastening portion 500, and then rotates the upper filter housing 510 and the lower filter housing 520 in opposite directions by a certain rotational force or higher, the stopper projection 531 is disengaged from the stopper insertion groove 532, thereby allowing the upper filter housing 510 and the lower filter housing 520 to be separated.

For example, the stopper protrusion 531 may include a circular protrusion 531*a* and a triangular protrusion 531*b*.

In this case, the circular protrusion 531*a* and the triangular protrusion 531*b* are spaced apart from each other in the circumferential direction, and the base of the triangular protrusion 531*b* is disposed toward the circular protrusion 531*a*.

At this time, the stopper insertion groove 532 has a circular groove 532*a* and a triangular groove 532*b* corresponding to the circular protrusion 531*a* and the triangular protrusion 531*b* such that the circular protrusion 531*a* and the triangular protrusion 531*b* are respectively inserted thereinto.

When the stopper protrusion 531 consists of the circular protrusion 531*a* and the triangular protrusion 531*b*, and the base of the triangular protrusion 531*b* is disposed toward the circular protrusion 531*a*, the protrusion may be more easily disengaged when the user rotates the upper filter housing 510 in the direction in which an edge of the triangular protrusion 531*b* is disposed.

That is, since the edge of the triangular protrusion 531*b* is in line contact with the triangular groove 532*b*, but the base of the triangular protrusion 531*b* comes into surface contact with the triangular groove 532*b*, the protrusion may be easily disengaged with less force since a contact area with the triangular groove 532*b* is small at the edge of the triangular protrusion 531*b*.

Of course, the shape of the stopper protrusion 531 is not limited, and may be formed in various types of protrusions.

The filter module 50 may further include a first sealing portion 541 sealing a gap such that the air flowing in the main body 2 passes only through the filter 580 disposed in the lower filter housing 520, and a second sealing portion 542.

The first sealing portion 541 is fastened to the upper filter housing 510 and may seal air between the upper filter housing 510 and the lower filter housing 520 so as not to leak air.

More specifically, the first sealing portion 541 may include a sealing portion body 541*a*, a first sealing member 541*b*, a second sealing member 541*c*, and a fastening member 541*d*.

The sealing portion body 541*a* is formed in a ring shape and is disposed inside the inner wall 521 of the lower filter housing 520.

The first sealing member 541*b* protrudes radially outward from one end of the sealing portion body 541*a*, and is fitted and fastened between the upper filter housing 510 and the inner wall 521 of the lower filter housing 520.

That is, the first sealing member 541*b* is disposed in the gap where the upper filter housing 510 is fastened to the inner wall 521 of the lower filter housing 520, thereby preventing air from leaking through the gap.

The second sealing member 541*c* protrudes radially outward from the other end of the sealing portion body 541*a*, and is disposed to face the inner circumferential surface of the inner wall 521 of the lower filter housing 520.

The second sealing member 541*c* is seated on the upper end of the flow guide 22 when the filter module 50 is combined with the main body 2. Through this, it is possible to primarily prevent air introduced through the flow guide 22 from leaking into a portion where the upper filter housing 510 and the inner wall 521 of the lower filter housing 520 are coupled.

The fastening member 541*d* protrudes in a vertical direction from the first sealing member 541*b* and may be inserted into and fastened to the fastening groove 515 formed in the upper filter housing 510.

That is, the fastening member 541*d* may be disposed to form a right angle with the first sealing member 541*b*, and in the state where the fastening member 541*d* is fastened to the upper filter housing 510 in this form, the first sealing member 541*b* may be inserted into a portion where the upper filter housing 510 and the inner wall 521 of the lower filter housing 520 are coupled.

The second sealing portion 542 is fastened to the lower filter housing 520 and is in close contact with the inner circumferential surface of the main body 2 such that sealing is achieved to prevent leakage of air through the gap between the lower filter housing 520 and the main body 2.

The second sealing portion 542 may have one side coupled to the edge of the filter cover 570 and the other side protruding radially outward.

That is, in a state where the second sealing portion 542 is fastened to the filter cover 570, the outwardly protruding portion thereof is brought into close contact with the inner circumferential surface of the second body 12 to prevent air from leaking.

The second sealing portion 542 may be fitted into and fastened to the filter cover 570 or integrally formed with the filter cover 570 by insertion injection molding.

Figure 9:
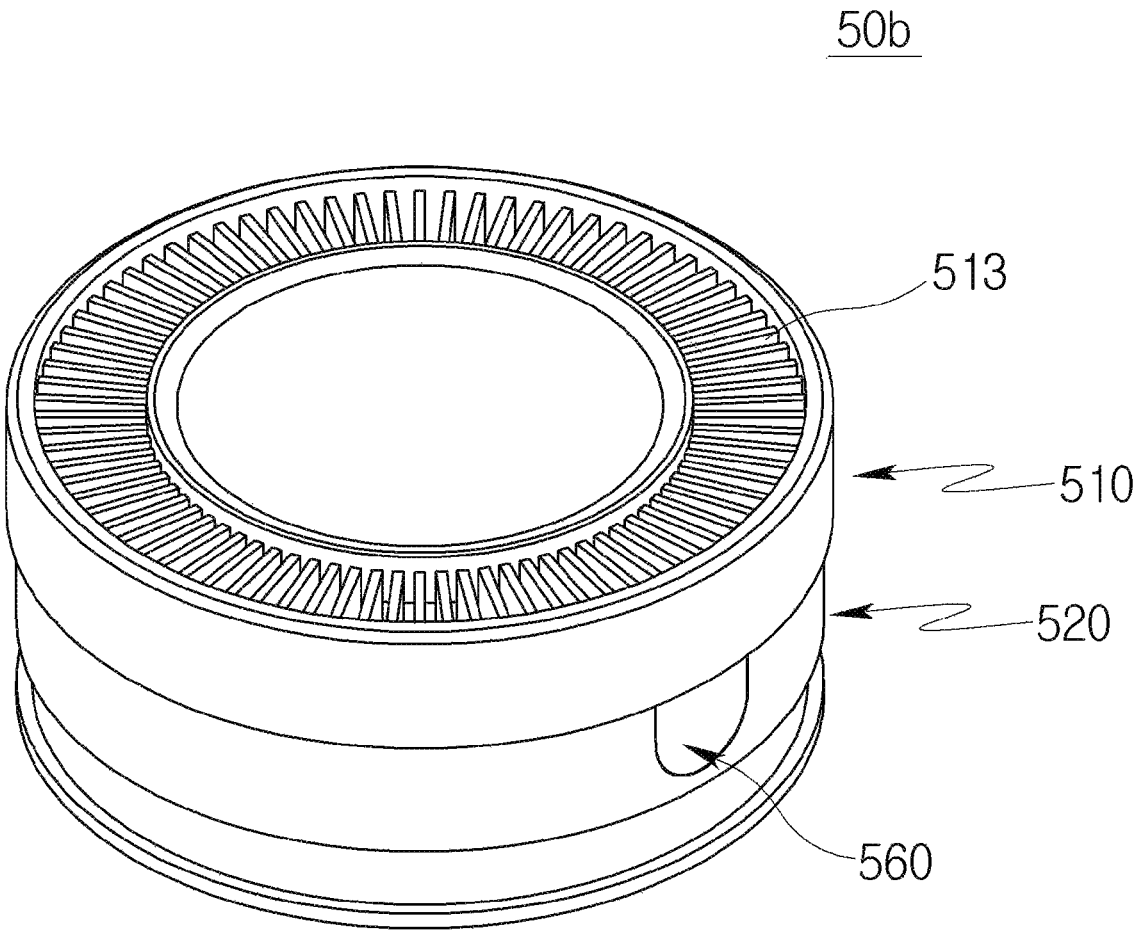
FIG. 9 is a schematic perspective view illustrating the filter module according to the second embodiment, which is taken from the cleaner according to an embodiment of the present disclosure.
Figure 10:
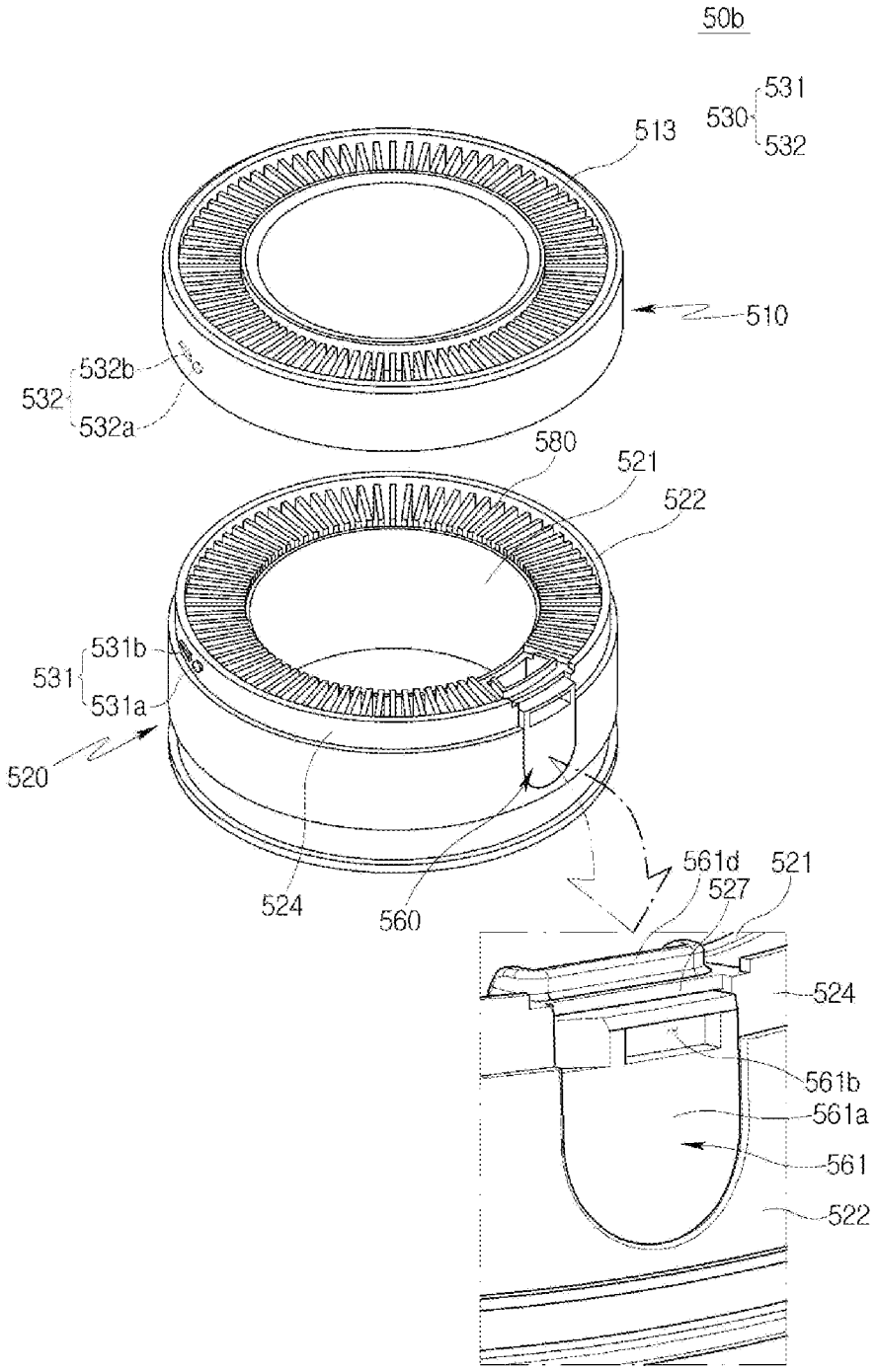
FIG. 10 is a schematic exploded perspective view illustrating the filter module according to the second embodiment of the cleaner according to an embodiment of the present disclosure.
Figure 11:
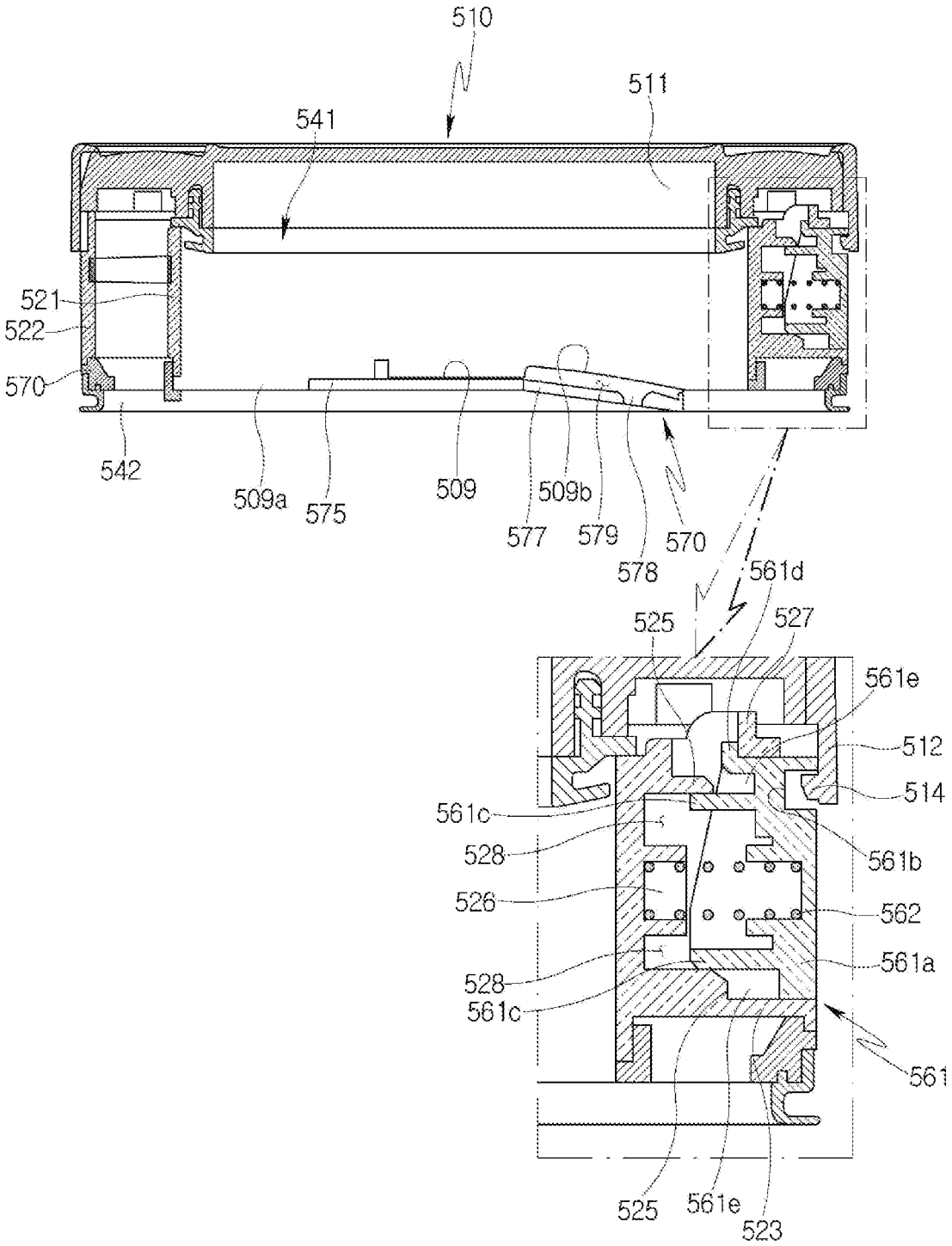
FIG. 11 is a schematic cross-sectional view illustrating the filter module according to the second embodiment of the cleaner according to an embodiment of the present disclosure.

FIGS. 9 to 11 are a perspective view, an exploded perspective view, and a cross-sectional view skeptically illustrating the filter module according to the second embodiment.

Referring to FIGS. 9 to 11, the filter module 50 according to the second embodiment of the present disclosure is different from the filter module 50 according to the first embodiment of the present disclosure described above only in the fastening portion, and the other components are the same.

That is, in the filter module 50 according to the second embodiment, the lower filter housing 520, the filter 580, the upper filter housing 510, and the stopper 530 are the same as those of the filter module 50 according to the first embodiment described above, and only the fastening portion 560 is different. Therefore, only the fastening portion 560 will be described in detail below.

The fastening portion 560 of the filter module 50 according to the second embodiment may include a pressing member 561 and an elastic member 562.

The pressing member 561 may be provided to move in a radial direction in the lower filter housing 520, and an accommodating groove 561*b* into which the hook portion 514 is inserted may be formed on the inner surface of the upper filter housing 510.

The elastic member 562 is disposed between the lower filter housing 520 and the pressing member 561, and applies an elastic force such that the pressing member 561 moves outward in a radial direction.

With this configuration, since the elastic force is applied to the pressing member 561 to be moved outward in the radial direction by the elastic force of the elastic member 562, by maintaining a state in which the accommodating groove 561*b* formed in the pressing member 561 is inserted into the hook portion 514 provided in the upper filter housing 510, a state in which the upper filter housing 510 and the lower filter housing 520 are fastened to each other can be maintained.

In addition, when the user presses the pressing member 561 to separate the upper filter housing 510 and the lower filter housing 520, the elastic member 562 is compressed by the pressing force, and the accommodating groove 561*b* formed in the pressing member 561 is detached from the hook portion 514, thereby separating the upper filter housing 510 and the lower filter housing 520 from each other.

More specifically, the pressing member 561 may include a pressing member body 561*a*, a guide protrusion 561*c*, a locking protrusion 561*d*, and a restricting groove 561*e*.

The pressing member body 561*a* is disposed to move between the outer wall 522 and the inner wall 521 of the lower filter housing 520, and the accommodating groove 561*b* may be formed at a portion where the pressing member body 561*a* overlaps the upper filter housing 510.

The guide protrusion 561*c* protrudes from the pressing member body 561*a* toward the inner wall 521 and is inserted into a slit groove 528 formed in the inner wall 521 to guide sliding of the pressing member body 561*a*.

The locking protrusion 561*d* protrudes from the pressing member body 561*a* toward the upper filter housing 510 and is supported by a locking jaw 527 formed in the lower filter housing 520 to prevent the locking protrusion 561*d* from escaping outward. Here, the locking jaw 527 may be formed as a part of the outer wall 522.

That is, the pressing member body 561*a* receives a pressing force to be separated from the lower filter housing 520 radially outward by the elastic force of the elastic member 562. Accordingly, the locking protrusion 561*d* formed in the pressing member body 561*a* is supported by the locking jaw 527 formed in the lower filter housing 520 and receives an elastic force such that the pressing member body 561*a* does not escape to the outside.

The restricting groove 561*e* may be formed so as to limit the inward movement of the pressing member body 561*a* as the restricting groove 561*e* is supported by a restricting protrusion 525 protruding from the inner wall 521 when the pressing member body 561*a* is moved inward.

That is, when the pressing member body 561*a* is pressed by the user and moves inward, the restricting groove 561*e* comes into contact with the restricting protrusion 525 and prevents the pressing member body 561*a* from moving further rearward, thereby restricting the movement range.

Accordingly, the pressing member 561 may move between the restricting protrusion 525 formed in the inner wall 521 and the locking protrusion 527 formed in the outer wall 522.

In addition, a first elastic member accommodating groove 526 is formed in the inner wall 521 of the lower filter housing 520 such that one end of the elastic member 562 is inserted thereinto and fixed thereto, and a second elastic member accommodating groove 526 may be formed such that the other end of the elastic member 562 is inserted thereinto and fixed thereto.

With this structure, both ends of the elastic member 562 are inserted into the first elastic member accommodating groove 526 and the second elastic member accommodating groove 526, respectively, such that the elastic member 562 may be fixed in position without separation.

Figure 12:
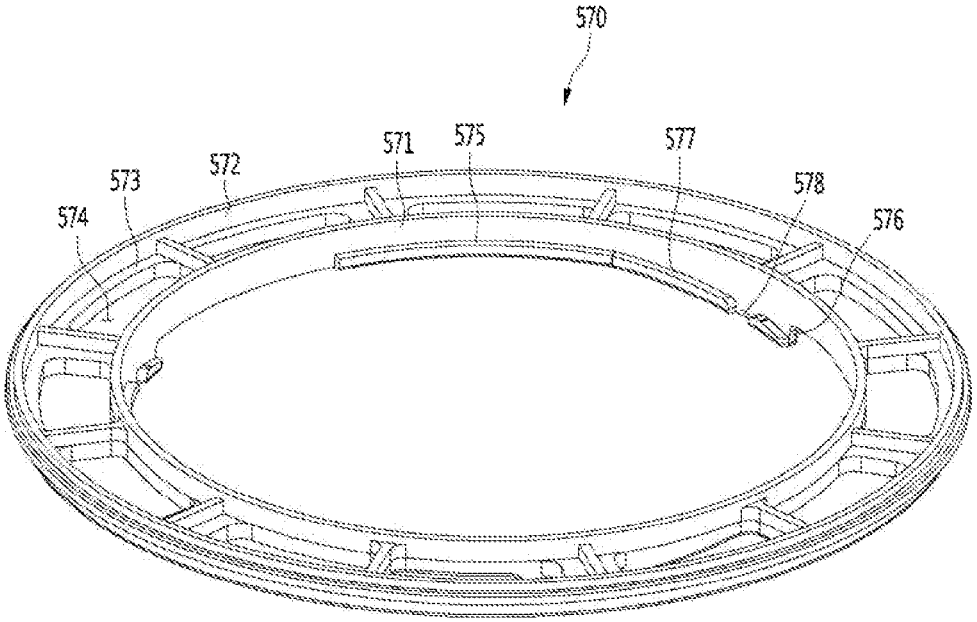
FIG. 12 is a schematic perspective view illustrating a filter cover of the lower filter housing, taken from the filter module of the cleaner according to an embodiment of the present disclosure.
Figure 13:
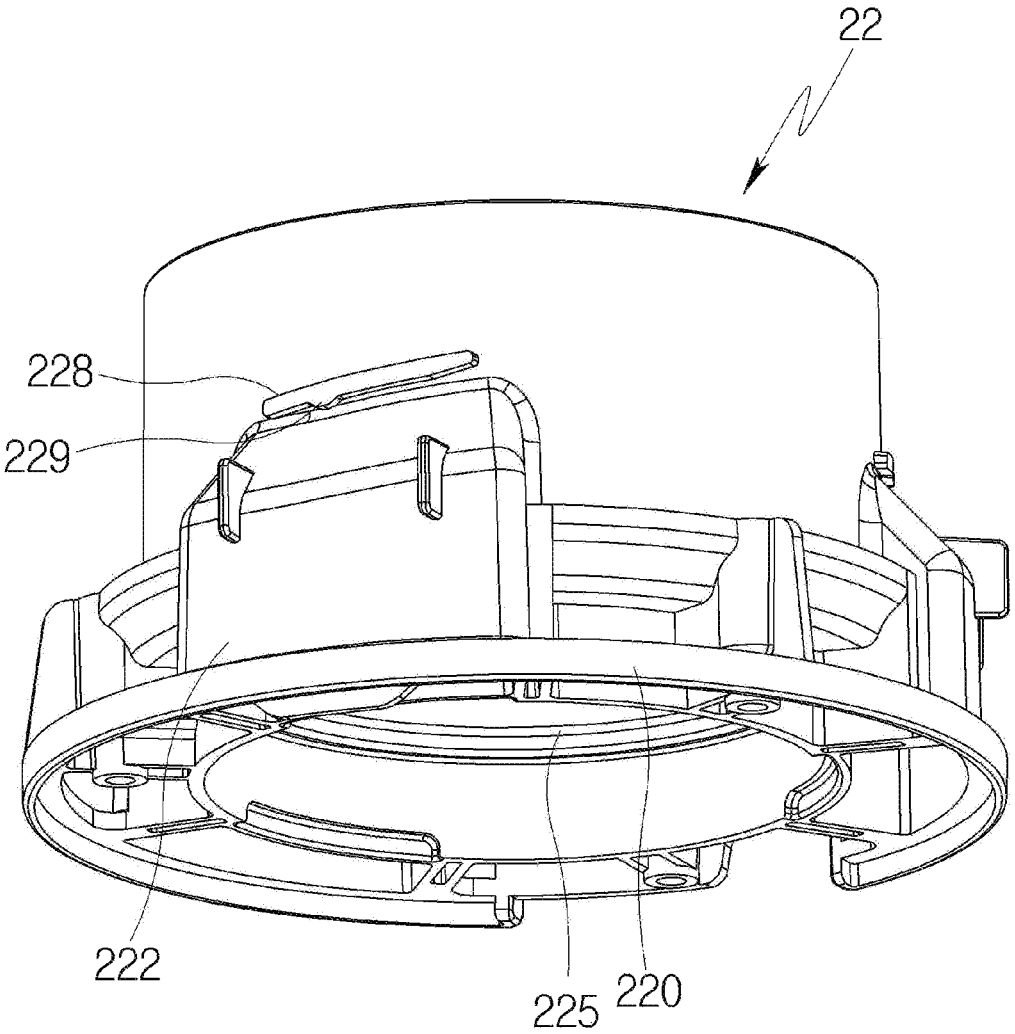
FIG. 13 is a schematic perspective view illustrating a flow guide taken from the cleaner according to an embodiment of the present disclosure.

FIG. 12 is a schematic perspective view illustrating the filter cover of the lower filter housing taken from the filter module, and FIG. 13 is a schematic perspective view illustrating the flow guide taken from the cleaner.

Referring to FIGS. 11 to 13, the filter cover 570 may include an inner body 571, an outer body 572 spaced apart from the inner body 571, and a connection body 573 connecting the inner body 571 and the outer body 572.

The inner body 571 and the outer body 572 may each be formed in a ring shape.

Here, the inner wall 521 may extend and protrude in a vertical direction from an end of the inner body 571, and the outer wall 522 may extend and protrude in a vertical direction from an end of the outer body 572.

The connection body 573 may include one or more openings 574 through which air passes.

A plurality of frame support ribs 575 may be provided on the inner circumferential surface of the inner body 571 to support the lower surface of the inner wall 521. The plurality of frame support ribs 575 may be spaced apart from each other in a circumferential direction of the inner wall 521.

A rib coupling portion 577 for coupling with the flow guide 22 may be provided on an inner circumferential surface of the inner body 571.

The inner body 571 may include an extension 576 such that the rib coupling portion 577 extends downwardly inclined. The extension 576 protrudes downward from the lower surface of the inner body 571, and the rib coupling portion 577 may be provided in the extension 576.

Accordingly, the rib coupling portion 577 extends in the circumferential direction from the end of the frame support rib 575 and extends to be inclined downward.

The rib coupling portion 577 is inclined downward so as to enable the rib coupling portion 577 to couple the filter module 50 to the main body 2 and release the filter module 50 from the main body 2 in a rotational manner, and the filter module 50 to be risen in the process of separating the filter module 50 from the main body 2.

When the filter module 50 rises in the process of being separated, the user may check whether the filter module 50 is being separated.

When the filter module 50 is configured to be detached during rotation of the filter module 50, a rotational force has to be applied to the filter module 50, so even if the filter module 50 is pulled, separation of the filter module from the main body 20 can be prevented. Accordingly, it is possible to prevent the filter module 50 from being unintentionally separated from the main body 2.

The rib coupling portion 577 may include a slot 578 in which a fixing protrusion 229 of the flow guide 22, which will be described later, is accommodated. Here, the slot 578 may be a groove or a hole.

The inner wall 521 may further include a contact portion 509*a* extending downward from a lower surface of the inner wall 521. The contact portion 509*a* may contact a side surface of the frame support rib 575 in a state in which the filter cover 570 and the inner wall 521 are coupled.

The inner wall 521 may include a recessed portion 509*b* formed by being recessed upward to form a rib accommodating portion 579 for accommodating the fixing rib 228 formed in the flow guide 22.

In a state in which the inner wall 521 is coupled to the filter cover 570, the recessed portion 509*b* is disposed on the rib coupling portion 577 and spaced apart from the rib coupling portion 577.

At this time, during the rotation and lowering of the filter module 50, the recessed portion 509*b* may be formed to be inclined such that the fixing rib 228 of the flow guide 22 can be accommodated in the rib accommodating portion 579 between the recessed portion 509*b* and the rib coupling portion 577.

Accordingly, the rib accommodating portion 579 also extends to be inclined downward. The rib accommodating portion 579 may be understood as a space between the inner wall 521 and the filter cover 570. That is, the fixing rib 228 of the flow guide 22 may be inserted between the inner wall 521 and the filter cover 570.

The flow guide 22 may include a guide body 220 which is open at the top and bottom. The guide body 220 may include a passage forming wall 222 for forming the first air passage 232 through which the air discharged from the second cyclone unit 130 flows.

The passage forming wall 222 may protrude from the guide body 222 in a radial direction.

At this time, the flow guide 22 may include a plurality of passage forming walls 222 spaced apart in the circumferential direction such that air can flow smoothly.

The suction motor 20 is located inside the flow guide 22. In order not to increase the size of the main body 2, the gap between the flow guide 22 and the suction motor 20 should not be large. However, there is a problem in that air flow performance deteriorates if the gap between the flow guide 22 and the suction motor 20 is not large.

However, as in the present disclosure, when the passage forming wall 222 protrudes radially from the guide body 220, a sufficient cross-sectional area of the flow passage through which air can flow is secured by the passage forming wall 222, thereby allowing air flow performance to be improved.

The passage forming wall 222 is formed at a position spaced apart from the upper end of the flow guide 22 by a certain interval to the lower side thereof such that the passage forming wall 222 does not interfere with the filter module 50 while the upper side of the flow guide 22 is accommodated in the inner wall 521.

Also, an outer diameter of the upper portion of the guide body 220 may be smaller than an inner diameter of the circumferential portion of the inner wall 521. Therefore, when the filter module 50 is coupled to the main body 2, the upper portion of the flow guide 22 is accommodated in the filter module 50 such that the first sealing portion 541 can be seated on top of the flow guide 22.

According to the present disclosure, since a portion of the flow guide 22 is accommodated in the filter module 50, an increase in the height of the cleaner 1 may be minimized.

Hereinafter, a coupling process of the filter module 50 will be described.

In order to couple the filter module 50 to the main body 2, a lower portion of the filter module 50 is accommodated in the second body 12.

Then, the rib accommodating portion 579 of the filter module 50 and the fixing rib 228 may be aligned.

In this state, when the filter module 50 is rotated, the fixing rib 228 is accommodated in the rib accommodating portion 579.

At this time, in order for the fixing rib 228 to be easily accommodated in the rib accommodating portion 579, the height of the rib accommodating portion 579 may be formed higher than the height of the fixing rib 228.

Since the fixing rib 228 extends so as to be inclined, the filter module 50 is lowered by the fixing rib 228 during rotation of the filter module 50.

When the fixing protrusion 229 is inserted into the slot 578 of the rib coupling portion 577 while the fixing rib 228 is accommodated in the rib accommodating portion 579, the coupling of the filter module 50 and the main body 2, that is, the coupling of the filter module 50 and the flow guide 22 is completed.

Meanwhile, in order to separate the filter module 50 from the main body 2, the filter module 50 is rotated in the other direction. At this time, since the fixing rib 228 is inclined, the filter module 50 is elevated by the fixing rib 228 during rotation of the filter module 50. Also, when the fixing rib 228 is removed from the rib accommodating portion 579, the coupling between the filter module 50 and the main body 2 is released.

In this state, when the filter module 50 is moved upward, the filter module 50 may be separated from the main body 2.

Figure 14:
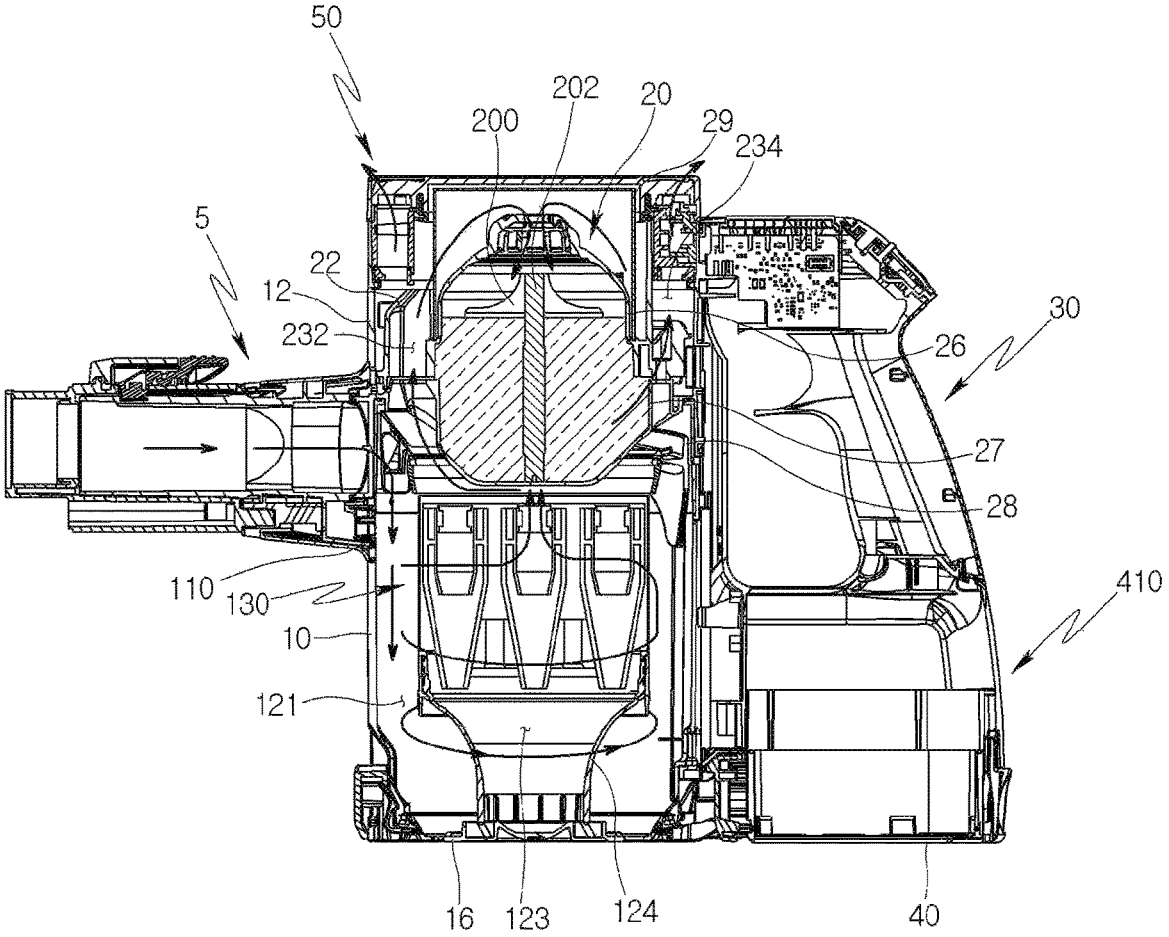
FIG. 14 is a schematic cross-sectional view illustrating an air flow in the cleaner according to an embodiment of the present disclosure.

FIG. 14 is a schematic cross-sectional view illustrating an air flow in the cleaner according to the embodiment of the present disclosure.

Referring to FIG. 14, the air flow in the cleaner 1 will be described.

Air and dust sucked through the suction unit 5 by the operation of the suction motor 20 are separated from each other while flowing along the inner circumferential surface of the first cyclone unit 110.

The dust separated from the air flows downward and is stored in the first dust storage unit 121. The air separated from the dust flows into the second cyclone unit 130. The air flowing into the second cyclone unit 130 is separated from the dust again.

The dust separated from the air in the second cyclone unit 130 flows downward and is stored in the second dust storage unit 123. On the other hand, the air separated from the dust in the second cyclone unit 130 is discharged from the second cyclone unit 130 and rises toward the suction motor 20.

The air discharged from the second cyclone unit 130 flows along the discharge guide 28, passes through the lower motor housing 27, and rises along the first air passage 232 in the flow guide 22. Then, the air in the first air passage 232 passes through the pre-filter 29.

The air that has passed through the pre-filter 29 passes through the suction motor 20 in the upper motor housing 27. After the air flows inside the suction motor 20 by the impeller 200, the air is discharged to the lower motor housing 28. Further, the air discharged to the lower motor housing 28 is diverted by the air guide 272 and flows into the second air passage 234.

The air flowing into the second air passage 234 passes through the filter 580 and then is discharged to the outside through the air exits 513.

The present disclosure has been described in detail with reference to the exemplary embodiments, but the exemplary embodiments are illustrative and the present disclosure is not limited thereto. It is apparent that those skilled in the art may modify or improve the exemplary embodiments within the technical spirit of the present disclosure.

All of the simple modifications or changes of the present disclosure belong to the scope of the present disclosure, and the specific protection scope of the present disclosure may be apparent by the accompanying claims.

What is claimed is:

1. A cleaner comprising:

a main body;

a suction motor disposed in the main body and configured to generate a suction force so as to suction air;

a dust separator configured to separate dust from air by generating a cyclone flow in air introduced by the suction motor; and a filter module having a filter configured to filter air discharged from the suction motor and being detachable from the main body, wherein the filter module is made to be separated and assembled such that the filter provided therein is washable or replaceable, wherein the filter module comprises:

a lower filter housing detachably fastened to the main body and configured to accommodate the filter;

an upper filter housing fastened to the lower filter housing and having air exits through which air passing through the filter is discharged; and a fastening portion provided in the lower filter housing and to selectively fasten and fix the upper filter housing, and wherein the fastening portion includes:

a pressing member provided to move in a radial direction in the lower filter housing and having an accommodating groove into which a hook portion formed on an inner surface of the upper filter housing is inserted; and an elastic member disposed between the lower filter housing and the pressing member and applying an elastic force such that the pressing member moves outward in a radial direction.

2. The cleaner of claim 1, wherein the fastening portion has one end in which an accommodating groove allowing the hook portion formed on the inner surface of the upper filter housing to be inserted thereinto is formed, and another end integrally provided in the lower filter housing so as to be elastically bent and deformed by an external force.

3. The cleaner of claim 2, wherein the accommodating groove is formed to restrain the upper filter housing from being rotated relative to or separated from the lower filter housing in a state in which the hook portion is inserted thereinto.

4. The cleaner of claim 2, wherein the fastening portion is formed by cutting one area of an outer wall of the lower filter housing.

5. The cleaner of claim 1, wherein the pressing member comprises:

a pressing member body disposed to be moved between an outer wall and an inner wall of the lower filter housing, and having the accommodating groove formed at a portion overlapping the upper filter housing; and a guide protrusion protruding from the pressing member body toward the inner wall and being inserted into a slit groove formed in the inner wall to guide movement.

6. The cleaner of claim 5, wherein the pressing member further comprises:

a locking protrusion protruding from the pressing member body toward the upper filter housing and supported by a locking jaw formed on the lower filter housing to prevent the locking protrusion from escaping outward; and a restricting groove supported by the locking protrusion protruding from the inner wall to restrict inward movement when the pressing member body is moved inward.

7. The cleaner of claim 1, wherein the elastic member has one end inserted into a first elastic member accommodating groove formed in the inner wall of the lower filter housing and fixed in position, and another end inserted into a second elastic member accommodating groove formed in the pressing member and fixed in position.

8. The cleaner of claim 1, wherein in the filter module, the upper filter housing is inserted into an insertion portion formed to have a smaller thickness at an upper end of the lower filter housing and is coupled to each other so as to be rotatable relative to each other, and the upper filter housing is fastened to the lower housing by the fastening portion in one area thereof.

9. The cleaner of claim 8, wherein the filter module further comprises stoppers coupled to each other only at a fastening position such that a fastening location where the upper filter housing is fastened by the fastening portion in one area is recognizable.

10. The cleaner of claim 9, wherein one of the stoppers comprises:

a stopper protrusion protruding outward from the insertion portion of the lower filter housing and spaced apart from the fastening portion by a certain angle; and a stopper insertion groove formed on the inner surface of the upper filter housing to allow the stopper protrusion to be inserted thereinto and spaced apart from the hook portion formed on the inner surface of the upper filter housing by a certain angle.

11. The cleaner of claim 10, wherein in the stopper, the stopper protrusion is separated from the stopper insertion groove when the lower filter housing and the upper filter housing are rotated relative to each other by a certain rotational force or more.

12. The cleaner of claim 10, wherein the stopper protrusion is formed by a circular protrusion and a triangular protrusion spaced apart from each other in a circumferential direction, and a base of the triangular protrusion is disposed toward the circular protrusion; and the stopper insertion groove is formed in a shape corresponding to the circular protrusion and the triangular protrusion such that the circular protrusion and the triangular protrusion are respectively inserted thereinto.

13. The cleaner of claim 1, wherein the lower filter housing comprises:

a filter cover provided in a ring shape, having a plurality of through holes through which air flows, and having a rib coupling portion formed to be detachable from a fixing rib formed in the main body;

an inner wall disposed to protrude in a direction perpendicular to an inner diameter of the filter cover; and an outer wall disposed to protrude in a direction perpendicular to an outer diameter of the filter cover, and wherein the filter is accommodated between the inner wall and the outer wall.

14. The cleaner of claim 1, wherein the filter module comprises:

a first sealing portion fastened to the upper filter housing and sealing such that air does not leak between the upper filter housing and the lower filter housing; and a second sealing portion fastened to the lower filter housing and closely coming in contact with an inner circumferential surface of the main body to seal air so as not to leak air through a gap between the lower filter housing and the main body.

15. The cleaner of claim 14, wherein the first sealing portion comprises:

a sealing portion body formed in a ring shape;

a first sealing member protruding radially outward from one end of the sealing portion body and fitted and fastened between the upper filter housing and the lower filter housing;

a second sealing member protruding radially outward from another end of the sealing portion body and disposed to face an inner circumferential surface of the lower filter housing; and a fastening member protruding vertically from the first sealing member and inserted into and fastened to a fastening groove formed in the upper filter housing.

* * * * *